US008402615B2

(12) United States Patent
Cheng

(10) Patent No.: US 8,402,615 B2
(45) Date of Patent: Mar. 26, 2013

(54) HOOK STRUCTURE AND INJECTION MOLDED HOOK STRAP INCLUDING THE SAME

(75) Inventor: Cheng-Wei Allen Cheng, Chang Hwa Hsien (TW)

(73) Assignee: Taiwan Paiho Limited, Chang Hwan Hsien (TW)

( * ) Notice: Subject to any disclaimer, the term of this patent is extended or adjusted under 35 U.S.C. 154(b) by 267 days.

(21) Appl. No.: 12/923,416

(22) Filed: Sep. 21, 2010

(65) Prior Publication Data

US 2011/0258819 A1 Oct. 27, 2011

(30) Foreign Application Priority Data

Apr. 21, 2010 (TW) ..... 99112500 A

(51) Int. Cl.
*A44B 18/00* (2006.01)

(52) U.S. Cl. ..... 24/452; 428/100

(58) Field of Classification Search ..... 24/452, 24/442; 428/100

See application file for complete search history.

(56) References Cited

U.S. PATENT DOCUMENTS 4,984,339 A * 1/1991 Provost et al. ..... 24/452
5,058,247 A * 10/1991 Thomas et al. ..... 24/448
5,325,569 A * 7/1994 Goulait et al. ..... 24/448
5,551,130 A * 9/1996 Tominaga et al. ..... 24/452
D376,533 S * 12/1996 Akeno ..... D8/382
5,604,963 A * 2/1997 Akeno ..... 24/452
5,657,517 A * 8/1997 Akeno et al. ..... 24/452
5,781,969 A * 7/1998 Akeno et al. ..... 24/452
5,839,172 A * 11/1998 Takizawa et al. ..... 24/452
6,180,205 B1 * 1/2001 Tachauer et al. ..... 428/100
6,209,177 B1 * 4/2001 Murasaki ..... 24/452

* cited by examiner

*Primary Examiner* — Robert J Sandy
*Assistant Examiner* — Abigail E Morrell
(74) *Attorney, Agent, or Firm* — Bacon & Thomas, PLLC

(57) ABSTRACT

A hook, in a mechanical fastener, includes a hook body having a base, at least one hook arm and a hook body side-curved portion corresponding to the at least one hook arm, the at least one hook arm including a hook end and a neck portion between the hook body and the hook end, the neck portion having an inner curved portion opposing to the hook body side-curved portion. The hook body side-curved portion is defined by a portion of a circumference of a first circle, the inner curved portion of the neck portion is defined by a portion of a circumference of a second circle and the hook end is defined by a portion of a circumference of a third circle.

4 Claims, 4 Drawing Sheets

HOOK STRUCTURE AND INJECTION MOLDED HOOK STRAP INCLUDING THE SAME

FIELD OF THE INVENTION

The present invention relates generally to mechanical fasteners, and more specifically to a hook structure and an injection molded hook strap of a mechanical fastener including the same.

BACKGROUND OF THE INVENTION

A hook-and-loop type fastener is a well know mechanical fastener and wildly used in a variety of fields that need to fasten two separate parts together, such as garment, hats/caps, shoes, personal care product (such as diapers) etc., because of its easy engaging/disengaging characteristic. Recently, traditional hook straps are replaced with injection molded hook straps in the hook-and-loop fastener market because the injection molded hook straps are not only lighter and thinner than traditional hook straps, but also posses advantages over traditional hook straps, such as providing larger lateral pulling strength/peel-off strength, causing less loosen threads during processing, providing higher finished product quality. Additionally, while processed with post-processing process, such as printing, dying, high frequency processing, the injection molded hook straps can provide more add-values, such as providing an artistic appearance and showing the brand name etc.

Although existing injection molded type hook straps are wildly adapted in a variety of applications because of possessing advantages mentioned above, they are still unable to meet various needs in different fields because the structural deficiencies of the hook itself causes problems and limitations, such as stress concentration, destruction of the hooks and the loops, insufficient lateral engagement strength, etc.

Specifically, FIG. 1 schematically shows an illustration of an existing injection molded hook 1 including a hook body 2 which is relatively inflexible and substantially perpendicular to a substrate 3 of a hook strap. Curved portions of the entire hook 1 only exist at the hook neck 4 and the hook end 5. When the hook end 5 disengages with the loop 6, the disengaging force will concentrate at the hook neck 4 because the hook body 2 stiffer than the hook neck 4, and this in turn will cause the hook neck 4 and hook end 5 to deform to a degree that exceeds the yield strength of the plastic material of the hook and thus produces plastic deformation of the hook end 5. Therefore, the hook neck 4 and hook end 5 will be gradually straightened such that the hook 1 is unable to effectively engage with the loop and the engagement strength is thus weakened, and then the hook strap will lose its fastening function in the end.

Additionally, if the loop 6' does not engage with the hook 1 at the hook neck 4 or the hook end 5 but at the hook body 2, then when the loop 6' disengages with the hook 1, the interaction force between the hook loop 6' and the hook 1 will occur at the relatively rigid and inflexible hook body 2. Because the interaction force acting on the hook body 2 is unable to be properly relieved by an elastic deformation of the hook body 2, the disengaging force turns into a lateral pulling force and causes the hook 1 and the loop 6' to pull each other. This lateral pulling force will break the hook 1 and/or the loop 6' and thus dramatically shorten the effective lifetime of the hook strap.

Moreover, the shape, the arrangement and the density of the injection molded hooks of the hook strap will affect the loop strap that cooperate with it. During the engagement of the hook strap and the corresponding loop strap, the number of hooks of the hook strap that engage with the loops of the loop strap is the main feature that affect the fastening effect of the hook strap. Therefore, providing a hook strap with consistent and strong engagement strength is one of the goals that the fastener strap industry have been continuously try to reach.

In addition, during the engagement of the hooks and the loops, a change in engaging direction and engaging angle between the hooks and loops will cause single-direction injection molded hooks failing to engage with the loops. And, this problem relates the curvature of the hook arm and the distance between the hook end and the hook body. In other words, the distance between the hook end and the hook body and the length/curvature of the hook arm will affect the engaging/disengaging efficiency between the hooks/loops. Therefore, solving the fail-to-engage problem of the single-direction injection molded hooks caused by different engaging directions and angles during engagement by properly altering the fundamental structure of existing injection molded hooks is also one of the issues that the fastener strap industry is looking forward to accomplish.

SUMMARY OF THE INVENTION

In view of the above drawbacks and limitations, the inventor of the present invention has find out, after long and tedious researches, that these drawbacks and limitations of the existing injection molded hook strap may be solved in two ways:

1. Increasing the curvature of the hook body to improve the stress distribution between the hook body and the hook end such that during the interaction between the hook and the loop the stress concentration may be relieved through the larger curvature of the hook body so as to avoid the destruction of the hook and/or the loop caused by the stress concentration, to prolong the effective lifetime of the hook strap, to enhance the engagement strength, and to achieve a better fastening function of the injection molded fastener strap.

2. Increasing the interval between adjacent hooks by changing the arrangement and density of the injection molded hooks so as to increase the engaging probability between the hooks and the loops. Solving the fail-to-engage problem of the single-direction injection molded hooks resulting from different engaging directions and angles during engagement by properly altering the density of the injection molded hooks, the contour and curvature of the hook end, and the distance between the hook end and the hook body so as to reshape the hook.

According to above research results, one aspect of the present invention provides a novel hook of an injection molded hook strap of a mechanical fastener. The hook includes a hook body having a base integrally formed with a substrate of the hook strap, at least one hook arm and a hook body side-curved portion corresponding to the at least one hook arm, the at least one hook arm including a hook end and a neck portion between the hook body and the hook end, the neck portion having an inner curved portion opposing to the hook body side-curved portion, the hook being characterized in that: the hook body side-curved portion is defined by a portion of a circumference of a first circle, the inner curved portion of the neck portion is defined by a portion of a circumference of a second circle and the hook end is defined by a portion of a circumference of a third circle, wherein the first, second and third circles satisfy following relationships:

a) the second circle inscribes the first circle at the interior of the first circle and the second circle contacts, without intersecting, the third circle at the exterior of the third circle;

b) an absolute value of a difference between a distance (D1) measured from the center of the first circle to a. vertical central line (L) of the hook and a distance (D2) measured from the center of the second circle to the vertical central line (L) of the hook is less than 0.04 mm, i.e., $|D1-D2|<0.04$ mm;

c) the radius (R1) of the first circle is no less than two times of the radius (R2) of the second circle, i.e., $R1 \geqq 2R2$;

d) a distance (H3) measured from the center of the third circle to the substrate of the hook strap is less than a distance (H2) measured from the center of the second circle to the substrate of the hook strap, i.e., $H3<H2$; and e) an absolute value of a difference between the radius (R2) of the second circle and the radius (R3) of the third circle is less than 0.04 mm, i.e., $|R2-R3|<0.04$ mm.

According to one embodiment of the present invention, the at least one hook arm comprises a single hook arm extending in one direction.

According to another embodiment of the present invention, the at least one hook arm comprises two hook arms extending in two different directions.

Another aspect of the present invention provides an injection molded hook strap of a mechanical fastener. The hook strap includes a substrate and a plurality of hooks integrally formed on a surface of the substrate and having the structural features as described in the above-mentioned aspect of the invention.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings, wherein.

DETAILED DESCRIPTION OF THE INVENTION

Figure 1:
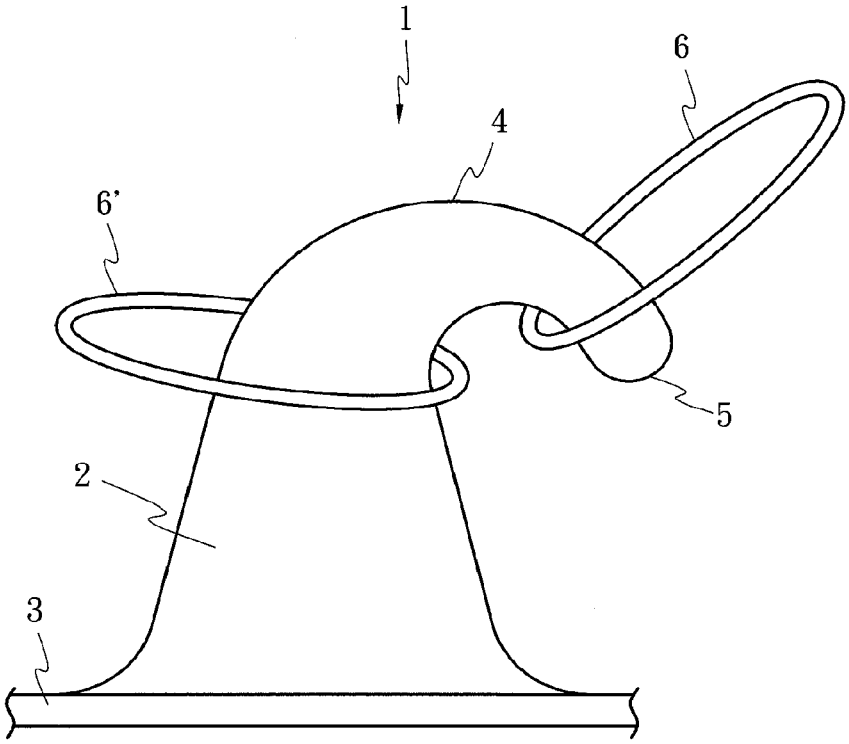
Fig. 1 (PRIOR ART)
FIG. 1 is a schematic plane view of a traditional hook of a fastener strap.
Figure 2:
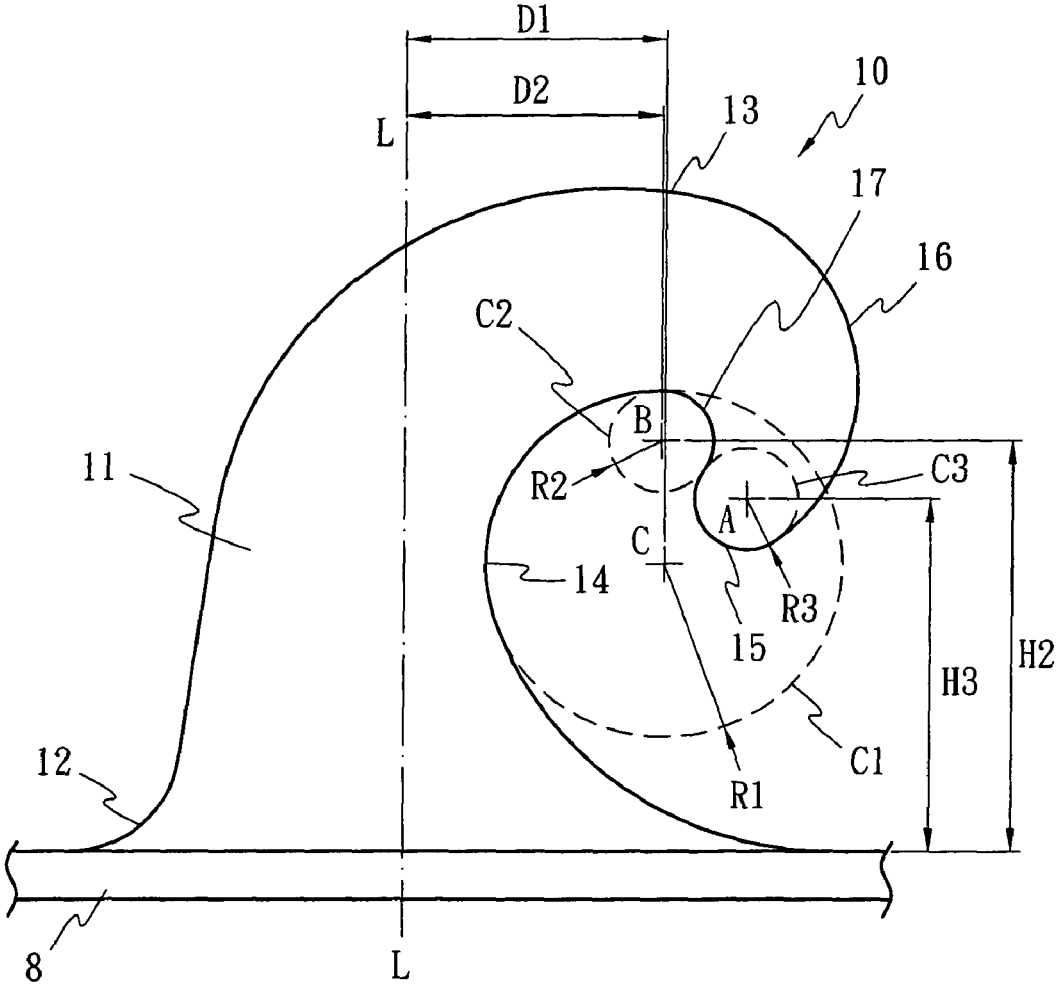
FIG. 2 is a schematic plane view showing a hook according to one embodiment of the present invention.
Figure 3:
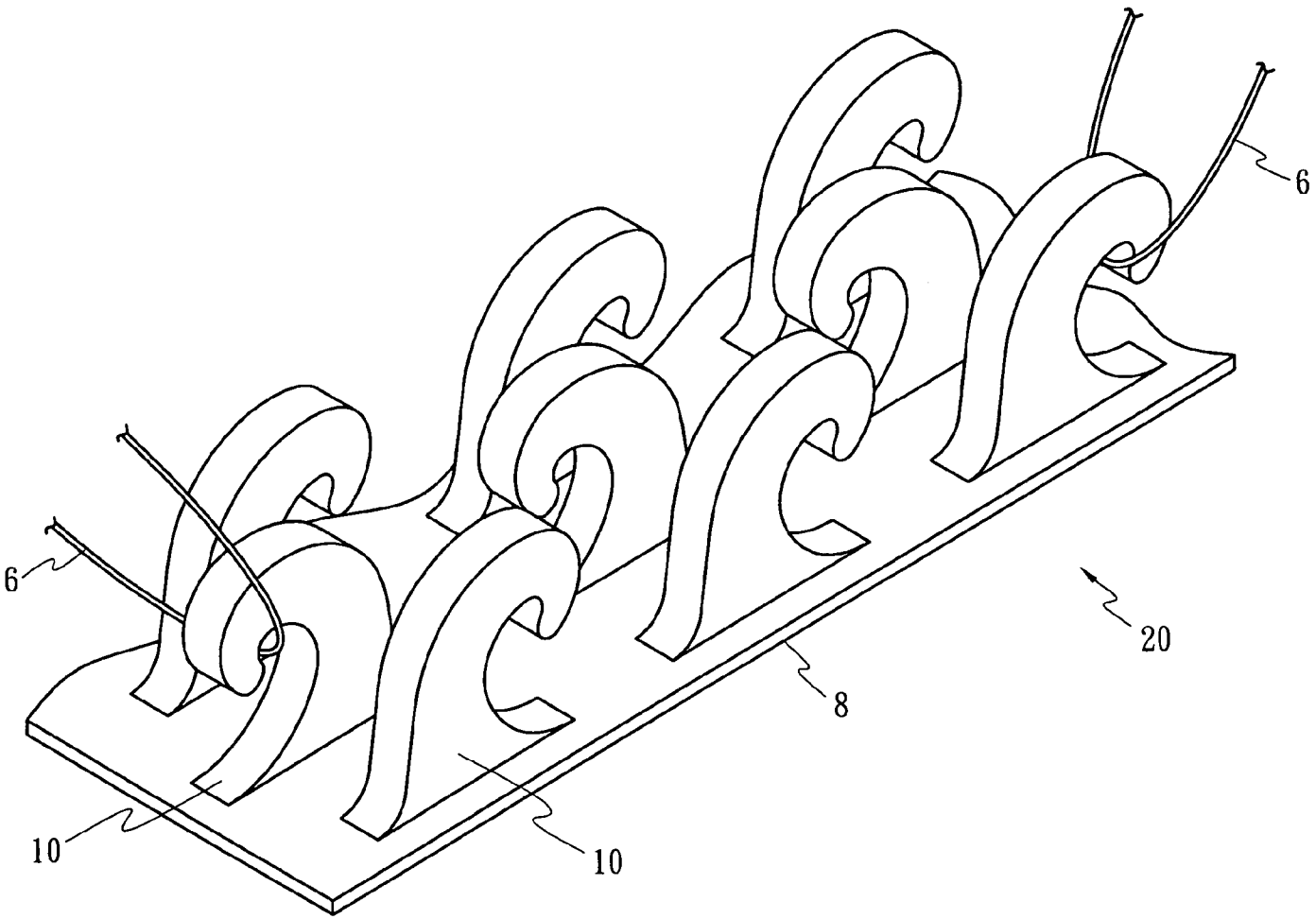
FIG. 3 is a schematic perspective view showing an injection molded hook strap comprising a plurality of hooks having the structural features as defined according to one embodiment of the present invention.

Referring now to FIGS. 2 and 3 in which a preferred embodiment of the hook of the present invention and an injection molded hook strap comprising a plurality of hooks according to the present invention is illustrated to describe the present invention.

FIG. 2 is a schematic plane view showing a hook of an injection molded hook strap according to one embodiment of the present invention. As shown in the drawing, the hook 10 of an injection molded hook strap includes a hook body 11 which has a base 12 integrally formed with a substrate 8 of the hook strap, a hook arm 13 and a hook body side-curved portion 14 corresponding to the hook arm 13. The hook arm 13 includes a hook end 15 and a neck portion 16 disposed between the hook body 11 and the hook end 15. The neck portion 16 has an inner curved portion 17 opposing to the hook body side-curved portion 14.

The curvature of the hook body side-curved portion 14 is defined by a portion of a circumference of a first circle C1 having a radius R1, wherein a distance measured from the center C of the first circle C1 to a vertical central line L of the hook 10 is defined as distance D1. The curvature of the inner curved portion 17 of the neck portion 16 is defined by a portion of a circumference of a second circle C2 having a radius R2, wherein a distance measured from the center B of the second circle C2 to the vertical central line L of the hook 10 is defined as distance D2 and a distance measured from the center B of the second circle C2 to the substrate 8 of the hook strap is defined as distance H2. The hook end 15 is defined by a portion of a circumference of a third circle C3 having a radius R3, wherein a distance measured from the center A of the third circle C3 to the substrate 8 of the hook strap is defined as distance H3.

In order to overcome the problems exist in traditional injection molded hooks, such as stress concentration and destruction of the hooks and loops etc., the hook 10 of the present invention is designed such that the relative spatial relationship among the first circle Cl, the second circle C2 and the third circle C3 (which define the curvature of the hook body side-curved portion 14, the curvature of the inner curved portion 17 of the neck portion 16 and the curvature of the hook end 15 respectively) is that: the second circle C2 inscribes the first circle C1 at the interior of the first circle C1 and the second circle C2 also contacts, without intersecting, the third circle C3. Additionally, the first circle C1 , the second circle C2 and the third circle C3 also have following dimensional and positional characteristics.

Firstly, an absolute value of a difference between the distance D1, which is measured from the center C of the first circle C1 to the vertical central line L of the hook 10, and the distance D2, which is measured from the center B of the second circle C2 to the vertical central line of the hook 10, is less than 0.04 mm, i.e., $|D1-D2|<0.04$ mm. Secondly, the radius RI of the first circle C1 is no less than two times of the radius R2 of the second circle C2, i.e., $R1 \geqq 2R2$. Thirdly, the distance H3, which is measured from the center A of the third circle C3 to the substrate 8 of the hook strap, is less than the distance H2, which is measured from the center B of the second circle C2 to the substrate 8 of the hook strap, i.e., $H3<H2$. Lastly, an absolute value of a difference between the radius R2 of the second circle C2 and the radius R3 of the third circle C3 is less than 0.04 mm, i.e., $|R2-R3|<0.04$ mm.

Because the hook 10 of the present invention has structural features described above, the hook body 11 and the hook arm 13 are more uniform in dimension and in physical characteristics. Therefore, during the disengaging between the hooks 10 and the loops, not only will the hook arm 13 elastically deform, the hook body 11 will also elastically deform to a degree such that the disengaging force will not concentrate on the hook arm 13. The plastic deformation of the hook arm 13 can thus be avoided and the deterioration of the fastening function can thereby be prevented.

Additionally, in the case where the hook 10 of the present invention engage the loop at the hook body 11, during the disengaging operation of the hooks 10 and the loops, not only can the disengaging force be properly relieved through the elastic deformation of the hook body 11, the disengaging force can also be suitably transferred to the hook arm 13 to prevent the disengaging force from turning into destructive lateral pulling force and the destruction of the hook 10 and the loop resulting from this lateral pulling between the hook and loop can thus be avoided. As a result, the effective lifetime of the hook strap can be dramatically prolonged.

Moreover, because the hook body 11 of the hook 10 of the present invention has proper elastic deformation and curvature, and the hook arm 13 has structural features described above, disengaging between the hooks and the loops can be prolonged during the disengaging operation, that is the engagement time between the hooks and loops may be extended during the disengaging operation. Thus, it is possible to provide the hook strap a more uniform, stable and strong fastening strength.

Because the hook 10 of the present invention provides both longer effective lifetime and stronger fastening strength, the hook 10 of the present invention thus can meet various needs of a variety of different applications. Additionally, the hook 10 of the present invention is particularly suitable for use in applications that require frequent engaging/disengaging operations of the hooks and the loops.

FIG. 3 is a schematic perspective view showing an embodiment of an injection molded hook strap 20 comprising hooks 10 of the present invention. In the embodiment shown in FIG. 3, a plurality of hooks 10 are integrally formed on a surface of a substrate 8 of the hook straps 20 and arranged in an array. Hook arms of the hooks 10 in the same row extend in the same direction, and hook arms of the hooks 10 in adjacent rows extend in opposite directions, as shown in FIG. 3. By arranging the hooks 10 in a manner as illustrated in FIG. 3, loops 6 may effectively engage with the hooks 10 in both directions so as to increase the probability of engagement as well as the number of engaged hooks and loops, and thus in turn increase the fastening strength of the entire hook strap 20.

Figure 4:
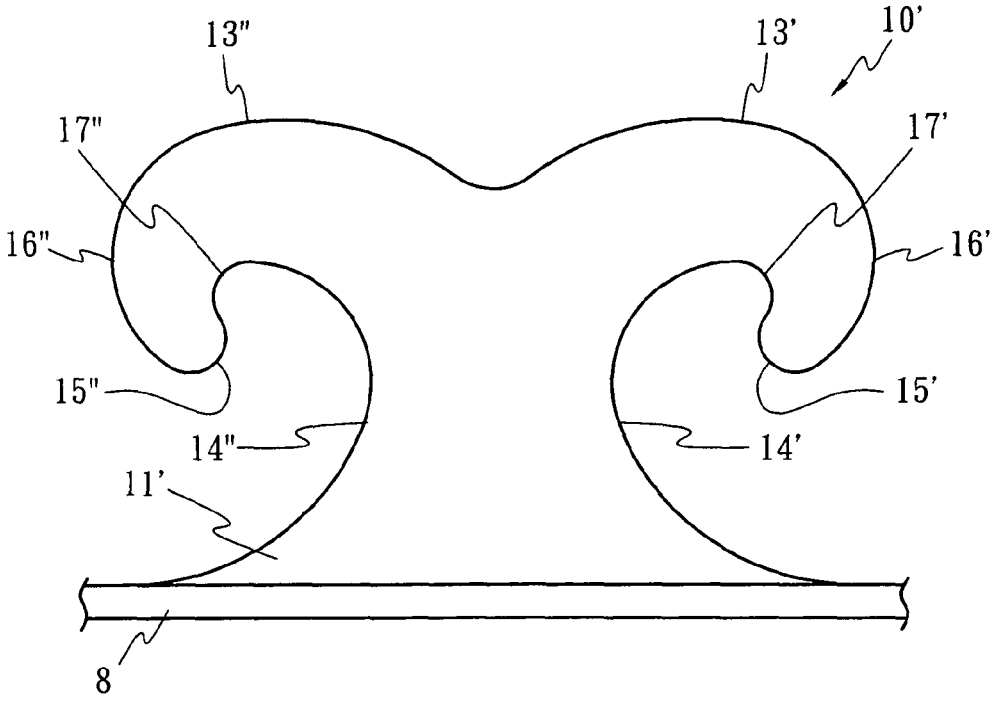
FIG. 4 is a schematic plane view showing a hook according to another embodiment of the present invention.

FIG. 4 is a schematic plane view showing an injection molded hook 10' according to another embodiment of the present invention. The embodiment illustrated in FIG. 4 is a bi-hook-arm type hook 10' which includes a hook body 11' and two hook arms 13', 13" extending in two different direction, such as in opposite directions as illustrated in FIG. 4. The hook body 11' has hook body side-curved portions 14', 14" at sides corresponding to the hook arms 13', 13". The hook arms 13', 13" respectively include a hook end 15', 15" and a neck portion 16', 16" disposed between the hook body 11' and the hook end 15', 15". The neck portion 16', 16" respectively has an inner curved portion 17', 17" opposing to the hook body side-curved portion 14', 14", as shown in FIG. 4. The above described components of the hook 10' have the same structural features as those of the corresponding components of the hook 10 illustrated in FIG. 2. Thus, not only does the hook 10' have all the advantages that the hook 10 has, but also can the hook 10' provide effective engagement with loops in different directions without any particular arrangement to the hooks 10' on the substrate 8. That is, the insufficient fastening strength caused by the fail-to-engage between the hooks and loops because of the engaging direction/angle may be effectively prevented so as to provide an engagement of the hooks and the loops without direction/angle limitations.

Although the present invention has been described above according to preferred embodiments of the hooks and hook strap including the hooks illustrated in the accompanying drawings, this does not mean that the scope of the present invention is limited to specific structures described above. In fact, there exist various modifications and variations under the principle and spirit disclosed above. For instance, although the above descriptions are made based on single hook arm type and bi-hook-arm type hook embodiments, the hook of the present invention can also be a hook that has three or four hook arms extending in different directions. Moreover, in addition to the bi-hook-arm type hook having two hook arms extending in opposite directions as illustrated in FIG. 4, the bi-hook-arm type hook of the present invention can also have two hook arms extending in directions that are 90° apart.

It will be apparent to people skilled in this art that many modifications can be made to the disclosed structures without departing from the true scope of the invention defined by the appended claims. Therefore, it is the intent of the appended claims to cover all such variations and modifications as come within the sprit and scope of this invention.

What is claimed is:

1. A hook, for an injection molded hook strap of a mechanical fastener, comprising:

a hook body having a base configured to be integrally formed with a substrate of the hook strap, at least one hook arm and a hook body side-curved portion corresponding to the at least one hook arm, the at least one hook arm including a hook end and a neck portion between the hook body and the hook end, the neck portion having an inner curved portion opposing to the hook body side-curve portion;

wherein the hook body side-curved portion is defined by a portion of a circumference of a first circle, the inner curved portion of the neck portion is defined by a portion of a circumference of a second circle and the hook end is defined by a portion of a circumference of a third circle, wherein the first, second and third circles satisfy following relationships:

a) the second circle inscribes the first circle at the interior of the first circle and the second circle contacts, without intersecting, the third circle at the exterior of the third circle;

b) an absolute value of a difference between a distance (Dl) measured from the center of the first circle (C1) to a vertical central line (L) of the hook and a distance (D2) measured from the center of the second circle (C2) to the vertical central line (L) of the hook is less than 0.04 mm, i.e., <0.04 mm;

c) the radius (R1) of the first circle (C1) is no less than two times of the radius (R2) of the second circle (C2), i.e., $R1 \geqq 2R2$;

d) a distance (H3) measured from the center of the third circle (C3) to the substrate of the hook strap is less than a distance (H2) measured from the center of the second circle (C2) to the substrate of the hook strap, i.e., $H3 < H2$; and e) an absolute value of a difference between the radius (R2) of the second circle (C2) and the radius (R3) of the third circle (C3) is less than 0.04 mm, i.e., <0.04 mm.

2. The hook according to claim 1, wherein the at least one hook arm comprises a single hook arm extending in one direction.

3. The hook according to claim 1, wherein the at least one hook arm comprises two hook arms extending in two different directions.

4. An injection molded hook strap of a mechanical fastener, comprising:

a substrate; and a plurality of hooks according to claim 1, 2 or 3 integrally formed on a surface of the substrate.

* * * * *